United States Patent [19]

Schmitz

[11] 4,303,996

[45] Dec. 1, 1981

[54] USER PROGRAMMABLE ALPHA-NUMERIC MESSAGE WATCH

[75] Inventor: Lawrence S. Schmitz, Costa Mesa, Calif.

[73] Assignee: Hughes Aircraft Company, Culver City, Calif.

[21] Appl. No.: 128,689

[22] Filed: Mar. 10, 1980

Related U.S. Application Data

[63] Continuation of Ser. No. 924,029, Jul. 12, 1978, abandoned, which is a continuation of Ser. No. 758,604, Jan. 12, 1977, abandoned.

[51] Int. Cl.[3] ..... G04C 19/00; G04C 9/00

[52] U.S. Cl. ..... 368/82; 368/187; 368/239

[58] Field of Search ..... 368/69, 70, 187–189, 368/239–242

[56] References Cited

U.S. PATENT DOCUMENTS

| | | | |
|---|---|---|---|
| 3,925,777 | 12/1975 | Clark | 368/223 |
| 3,999,050 | 12/1976 | Pitroda | 58/752 R |

FOREIGN PATENT DOCUMENTS

| | | |
|---|---|---|
| 1372620 | 10/1974 | United Kingdom . |
| 1462307 | 1/1977 | United Kingdom . |
| 1493640 | 11/1977 | United Kingdom . |
| 1518436 | 7/1978 | United Kingdom . |

*Primary Examiner*—Vit W. Miska

*Attorney, Agent, or Firm*—Walter J. Adam; William H. MacAllister

[57] ABSTRACT

An LED watch which is capable of displaying both horological information and up to five words of five characters each which are sequentially displayed. These alpha-numeric words are programmed by the watch user.

2 Claims, 3 Drawing Figures

| | | | | | | | |
|---|---|---|---|---|---|---|---|
| **A | I | P | W | 3 | **+ | | |
| B | Blank | Q | X | 4 | - | | |
| C | **J | R | Y | 5 | = | | |
| D | K | Blank | Z | 6 | - | | |
| E | L | **S | Blank | 7 | ? | | |
| F | M | T | **O | 8 | Blank | | |
| G | N | U | I | 9 | | | |
| H | O | V | 2 | Blank | | | |

USER PROGRAMMABLE ALPHA-NUMERIC MESSAGE WATCH

This is a continuation of application Ser. No. 924,029 filed July 12, 1978, now abandoned.

BACKGROUND OF THE INVENTION

1. Field of the Invention

This invention relates to digital electronic watches, and more particularly to a watch which displays horological information and alpha-numeric messages which can be programmed by the watch user:

2. Description of the Prior Art

In the art, a digital watch has been developed with a fixed message. But the message cannot be altered without essentially replacing the watch module.

With the watch of the present invention, the watch user can enter whatever message he desires. He can choose from the 26 letters of the alphabet, numbers 0–9, and several different symbols. He can program in dates to remember, such as birthdays and anniversaries, peoples names and phone numbers, use the watch as an electronic engraver and say such things as "To Ralph with Love—Alice." The possibilities of different alpha-numeric messages which the watch user can program are limitless.

SUMMARY OF THE INVENTION

The user programmable alpha-numeric message watch, in accordance with the invention consists of means which allow the watch user to display and program both horological and alpha-numeric message information.

Accordingly, it is an object of this invention to provide a watch which displays selectable horological information and which displays alpha-numeric messages which the watch user has programmed.

The features of the present invention, both as to its organization and manner of operation, together with further objects and advantages thereof, may be understood best by reference to the following description, taken in connection with the accompanying drawings.

DETAILED DESCRIPTION

Figures 1, 2:
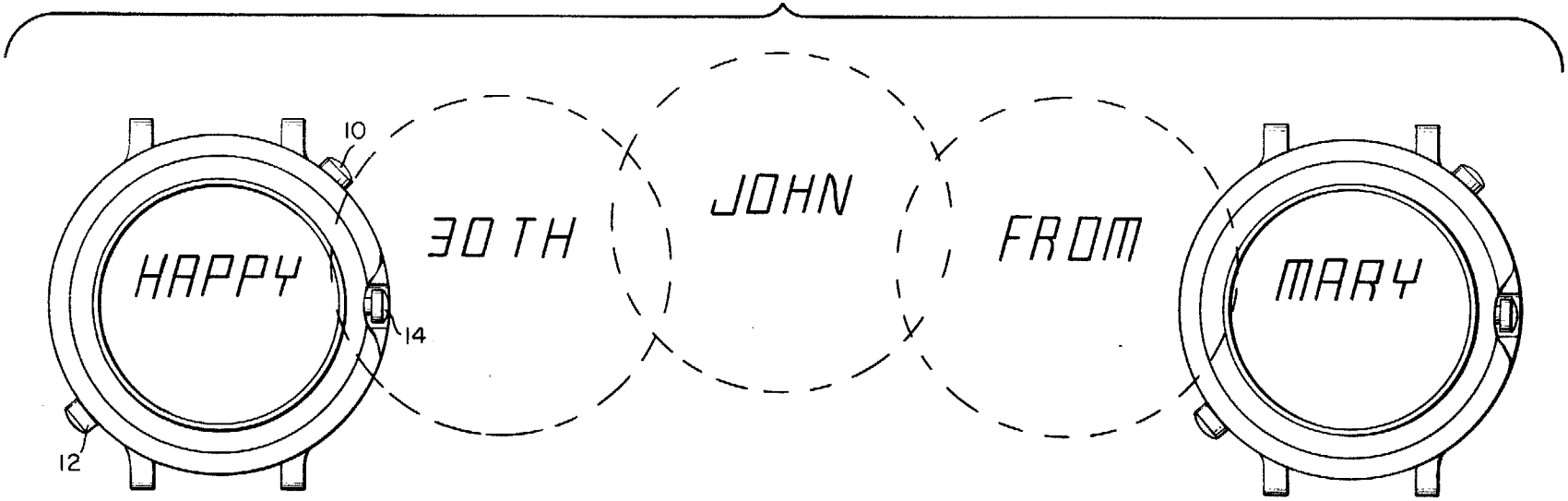
FIG. 1 shows the programmable message watch of the present invention displaying a possible message.
FIG. 2 is a list of the possible characters to be used in programming the message watch.

Referring now to FIG. 1, the digital watch is displaying a typical alpha-numeric message which the watch user may program into the watch. The digital watch of FIG. 1 has manually operable push buttons 10 and 12, which are easily accessible. Furthermore, the digital watch has a recessed button 14 which can be depressed by a pointed object for the purpose of resetting the horological information and for working in combination with push buttons 10 and 12 for programming or reprogramming the watch message.

The watch display consists of five 9-segment light emitting diode (LED) display devices. FIG. 2 shows the possible list of characters: 26 alpha, 10 numeric, 5 symbolic and five blanks which the watch user may choose when programming his watch. The characters shown in FIG. 2 are a matter of choice, a watch could be designed using other characters and symbols. The message watch of the present invention can be programmed by the watch user to display up to any five words, five-letters-per-word message.

In operation, one push of push button 10 causes the hours and minutes information to be displayed on the 9-segment LED readout. Two pushes of push button 10 causes the month and day information to be displayed; if push button 10 is held in, the seconds information will be displayed; and if push button 10 is pushed 3 times, "hands-off seconds" will be displayed (the seconds will count off automatically after the 3 pushes of push button 10 without any further pushes of push button 10). The next push of push button 10 resets "hands-off seconds". Depression of push button 12 will cause the messaage which the watch user has programmed into the watch to be sequentially displayed one word at a time until all 5 words have sequentially been displayed.

The foregoing describes a 2-button version message watch. Another embodiment would be a one-button version message watch in which one push of the single manually operable push button would display the hours and minutes information, and the seconds information after one second if the button is held in. Two pushes in 1 second of the single push button would display the month and day information, and 3 pushes in 2 seconds would display the programmed message.

The recessed button 14 is used to reset the horological information and to set or program the alpha-numeric message. One push of recess button 14 causes the month information to flash at a 2 hertz rate, momentarily pushing push button 10 causes the month's information to slew until the desired month's information is obtained and th user momentarily pushes push button 10 to stop the slewing. Two pushes of recessed button 14 causes the day information to flash and this information is slewed in a similar manner until the desired day is obtained. Further three pushes of button 14 causes the hour information followed either A.M. or P.M. to flash followed by pushing push button 10 in the same manner as previously described until the desired hour is obtained. Four pushes of button 14 causes the minutes information to flash. The minutes are slewed as above except that there is a 1 to 2 seconds delay to start slewing and the seconds are reset to zero when push button 10 is pushed to start slewing the minutes. Finally, 5 pushes of set button 14 causes the watch to enter the message set mode and for the first character of the first word to flash at a 2 hertz rate. Pushing push button 10 causes this first character of the first word to slew the possible characters as listed in FIG. 2 at a slow rate, 2 hertz. A further depression of push button 10 causes the slewing to stop at the desired character. If push button 10 is pushed and held in for 1 second, the watch would be in the fast slew to mode which will cause it to very quickly slew the next character with a double asterisks. The advantage of the fast slew is to allow the watch user to slew through the characters at a very rapid rate and to program the watch message in a matter of a few minutes instead of having to very slowly slew through each of the characters. After obtaining the correct character for the first space for the first word, the watch user then proceeds to the second character of the first word by depressing push button 12, which causes the second character to flash; further depression of push button 10 causes this second face to slew the characters of FIG. 2 until the desired character has been obtained.

Slewing always starts where the previous character stopped. The third, fourth, and fifth spaces of the first word are selected in a similar manner. When all five spaces of the first word have been programmed, the watch user returns to the first character of the first word by depression of push button 12 and followed by depression of button 14 a sixth time with a pointed object which causes the display to advance to the first character of the second word. The characters of the second, third, fourth, and fifth word are programmed in the same manner as the characters of the first word. If a blank space or five blank spaces are desired, they too must be programmed in and selected from the five blanks available in the list of characters of FIG. 2. In the programming mode only a blank appears as a comma(,).

The tenth push of button 14 returns the watch to the normal mode. Any word or character in a word may be reprogrammed independently by re-entering the setting sequence as previously described without destroying any of the other already programmed information.

In the two button version the funccions of button 12 in the message set mode is replaced by 2 pushes in 1 second of pusbutton 10.

Figure 3:
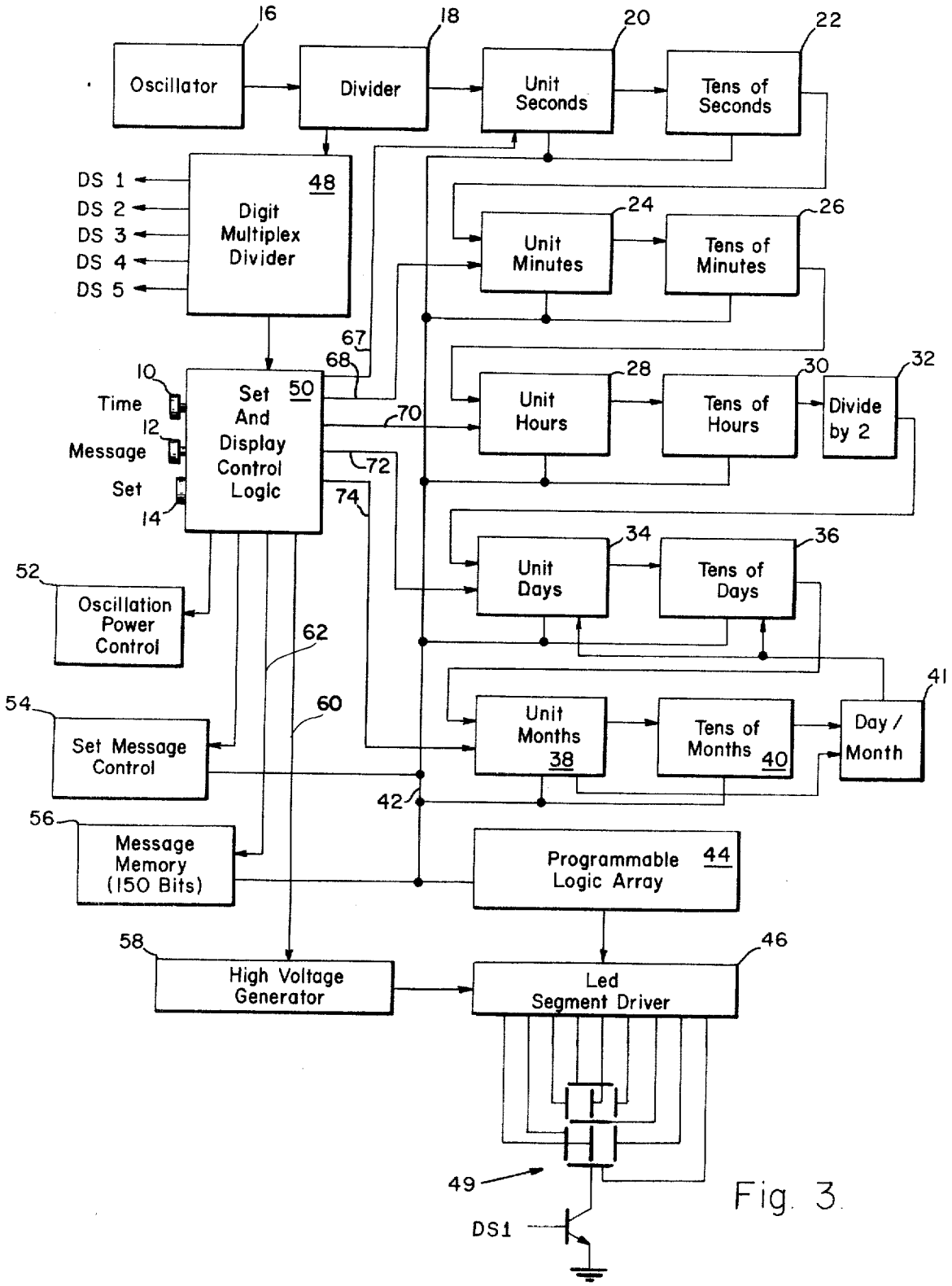
FIG. 3 is a block diagram of the circuitry of the message watch of the present invention.

The electronics employed in the watch of FIG. 1 are depicted in block diagram form in FIG. 3. These electronics consist of an electronic oscillator 16 which is crystal-controlled to oscillate at a predetermined and substantially constant frequency. Its, as well as the other circuits of this invention, are powered by two compact size batteries mounted on the bottom of the watch so that the entire structure can be mounted in a wristwatch or similar device. Several or all of the subcircuits can be and preferably are contained on the same CMOS circuit chip to minimize assembly labor and chances of misassembly, minimize size, and provide a watch of maximum reliability. The output from the crystal controlled oscillator 16 is driven into a standard CMOS divider 18 which results in an output pulse of one cycle per second. This one Hertz pulse is then driven into the unit seconds counter 20, which is a standard CMOS decade counter, which counts up to ten (0–9). The unit second counter in turn drives the CMOS tens-of-seconds counter 22 which must count up to six (0–5) to satisfy the requirement of 60 seconds per minute. All successive counters are designed so that at the end of each counter's normal count sequence a pulse is sent to the next counter in the sequence. This counter sequence can be thought of as a consecutive chain of dividers from which various points in the divider chain may be tapped to produce the desired seconds, minutes, hours, day and month outputs. All outputs taken from the counters are standard 1, 2, 4, 8 (4 bit) binary coded decimal (BCD). Similar to one unit seconds counter's operation, the tens-of-seconds counter 22 drives the unit minutes counter 24, which is a decade counter. The unit minute counter 24 then drives the tens-of-minutes counter 26 then drives the unit hours counter 28, which is a decade counter. Continuing the chain of divide counters, the unit hours counter 28 then drives the tens-of-hours counter 30.

The output signal from tens-of-hours counter 30 occurs twice a day. This output is connected through divide-by-2 counter 32 to the input of unit-days counter 34. Therefore, the unit-days counter 34 advance only once per day.

Counter 32 stores the information as to whether or not it is ante-meridiem (A.M.) or post-meridiem (P.M) and this A.M. or P.M. information is displayed during the horological setting mode.

Unit-days counter 34 thus receives a signal every day and emits a signal every ten days. Tens-of-days counter 36 need only reach 3, and thus does not need all of the binary coded decimal circuits to make it sufficiently complete to perform to other tasks. Tens-of-days counter 36 is linked to unit-days counter 34 so that, when the total attempts to pass 29, 30 or 31 days as determined by the months counter (days/month), counter 36 resets to zero and counter 34 resets to one. This reset advances the units months counter 38 which drives the tens-of-months counter 40. Counters 38 and 40 are arranged to count from 1 to 12 and control day/-month which predetermines if the days are reset in 29, 30 or 31 days.

Digit multiplex divider 48 causes the horological information present in the counters 24–40 and the message information present in message memory 56 to be displayed on the correct LED display device DS 1–5.

Set and display control logic 50 regulates the length of time that the horological and message information is to be displayed, and sequential manner in which the five words of the message are displayed. It also controls the sequential events in setting each function of the watch.

Oscillator power control 52 causes the one battery powering the oscillator 16 to switch to the second battery every 12 hours, and for the oscillator 16 to be powered by both batteries when the display 48 is illuminated. Control 52 is described in greater detail in Ser No. 682,431, and is incorporated by reference.

In operation, when the watch user desires to display the hours-minutes information he depresses push button 10, and a signal on line 60 activates high voltage generator 58 which provides gate drive to LED segment driver 46. Also, the control lines 67, 68, 70, 72 and 74 cause the transmission gates of the seconds, minutes hours days and month counters 20, 24, 28, 34 and 38 to open and to send the horological data present in said counters via bus 42 through PLA 44 to the display 49 by way of LED segment drivers 46.

High voltage generator 58, a voltage quadrupler, produces a higher potential so that the segment drivers can be made physically smaller, thereby saving space on the chip.

Depression of push button 12 causes a series of pulses via line 62 to message memory 56 causing the message present in memory 56 to be transferred non-volatile to PLA 44, which converts this BLD data to 9-segment form. Memory 56 also feeds this data back to itself so that the information is not destroyed.

Set button 14 is depressed five times to place the watch in the message setting mode. The fifth depression of button 14 causes set message control 54, which is a 6-bit counter and some control logic to slew and display the characters present in PLA 44. A depression of push button 10 then stops the pulses to set message control 54, in which turn stops the slewing. A depression of push button 12 causes message memory 56 to memorize the character present in set message control 54. This is done in accordance with the setting procedure previously described.

It is pointed out that although the present invention has been shown and described with reference to a particular embodiment, nevertheless, various changes and modifications obvious to one skilled in the art to which the invention pertains are deemed to lie within the purview of the invention.

What is claimed is:

1. The method of displaying horological and alpha-numeric information, of setting horological information and of programming alpha-numeric message information, in a watch with a first and second push button and a recessed button, said watch having a watch display, said displayed alpha-numeric information including a sequence of words each having a plurality of character positions for displaying characters, comprising the steps of:

depressing said first push button a predetermined number of times which causes horological information to be displayed by said watch display;

depressing said second push button, which causes the programmed alpha-numeric message information to be sequentially displayed by said watch display;

depressing said recessed button a predetermine number of times which causes the watch to be in one of a plurality of horological setting modes, momentarily depressing said first push button which then causes the horological information of that mode to be slewed until the desired horological state is reached and again monetarily depressing said first push button to stop the slewing;

depressing said recessed button an additional time which causes the watch to be in a message programming mode, whereupon the character at the first character position of the first word will flash at a predetermined rate, and depressing and holding in on said first push button which causes the watch to fast slew to one of a plurality of predetermined characters in a sequence of a plurality of alpha-numeric characters;

depressing said first push button causing the watch to slowly slew and display characters of said plurality of alpha-numeric characters until the watch user depresses said first push button again causing the watch display to stop on the desired character;

depressing said second push button while in said message programming mode which causes the watch display to advance to the next character position of the particular word being programmed and when the watch display has advanced to the last character position of the particular word, causes the watch display to then return to the first character position of the particular word;

depressing said recessed button an additional time which causes the setting to be advanced from the first character position of a particular word to the first character position of the next word; and when said watch has advanced through the character positions and returned to the first character position of the last word of said sequence of words, depressing said recessed button an additional time to remove said watch from said message setting mode.

2. The method of displaying horological and alpha-numeric information in a watch, of setting horological information into said wtach and of programming alpha-numeric message information into said watch with a first push button and a second recessed push button, said displayed horological information including hours and minutes information, seconds information and month and day information, said alpha-numeric information including a sequence of words each having a plurality of character positions for displaying characters, said watch having a watch display, comprising the steps of:

momentarily depressing said first push button which causes the hours and minutes information to be displayed by said watch display, holding said first push button a predetermined period which causes the seconds information to be displayed, and depressing said first push button a predetermined number of times in a predetermined interval which causes the month and day information to be displayed by said watch display;

depressing said first push button a predetermined number of times in a predetermined interval which causes the programmed alpha-numeric message information to be sequentially displayed by said watch display;

depressing said second push button a predetermined number of times which causes said watch to be in one of a plurality of horological setting modes, momentarily depressing said first push button which then causes the horological information of that mode to be slewed until the desired horological state is reached, and momentarily depressing said first push button to cause said slewing to stop at the dewired horological state;

depressing said second push button an additional time which causes said watch to be in a message programming mode, whereupon the character at the first character position of the first word will flash at a predetermined rate, and depressing and holding in on said first push button a predetermined interval which causes the watch to fast slew to one of a plurality of predetermind characters in a sequence of a plurality of alpha-numeric characters;

monentarily depressing said first push button causing said watch to slowly slew and display characters of said plurality of alpha-numeric characters until the watch user depresses said first push button causing the watch display to stop on the desired character;

depressing said first push button two times in a predetermined interval while in said message programming mode which causes the watch to advance to the next character position of the particular word being programmed and when the watch is advanced to the last character position of the particular word causes the watch to then return to the first character position of the particular word;

depressing said second push button an additional time which causes the setting to be advanced from the first character position of a particular word to the first character position of the next word; and when said watch has advanced through the character positions and returned to the first character position of the last word of said sequence of words, depressing said second push button an additional time to remove said watch from said message setting mode.

* * * * *